US008709123B2

(12) United States Patent
Ferrer et al.

(10) Patent No.: US 8,709,123 B2
(45) Date of Patent: Apr. 29, 2014

(54) DEGASSING OF MARTENSITIC STAINLESS STEEL BEFORE REMELTING BENEATH A LAYER OF SLAG

(75) Inventors: Laurent Ferrer, Lieusaint (FR); Patrick Philipson, Bois le Roi (FR)

(73) Assignee: SNECMA, Paris (FR)

( * ) Notice: Subject to any disclaimer, the term of this patent is extended or adjusted under 35 U.S.C. 154(b) by 66 days.

(21) Appl. No.: 13/501,568

(22) PCT Filed: Oct. 11, 2010

(86) PCT No.: PCT/FR2010/052141

§ 371 (c)(1),
(2), (4) Date: May 9, 2012

(87) PCT Pub. No.: WO2011/045514

PCT Pub. Date: Apr. 21, 2011

(65) Prior Publication Data

US 2012/0279350 A1 Nov. 8, 2012

(30) Foreign Application Priority Data

Oct. 12, 2009 (FR) ..... 09 57109

(51) Int. Cl.

| | |
|---|---|
| ***C21C 7/10*** | (2006.01) |
| ***C22B 9/18*** | (2006.01) |
| ***C21C 5/56*** | (2006.01) |
| ***C21C 7/072*** | (2006.01) |

(52) U.S. Cl.
USPC ..... 75/10.25; 75/508

(58) Field of Classification Search
USPC ..... 75/508, 10.66
See application file for complete search history.

(56) References Cited

U.S. PATENT DOCUMENTS

| | | | | |
|---|---|---|---|---|
| 4,359,337 | A * | 11/1982 | More | 75/306 |
| 4,589,916 | A | 5/1986 | Sasayama | |
| 5,252,120 | A * | 10/1993 | Finkl et al. | 75/508 |
| 5,364,588 | A * | 11/1994 | Finkl et al. | 420/67 |
| 5,524,019 | A | 6/1996 | Takenouchi et al. | |
| 5,820,817 | A * | 10/1998 | Angeliu et al. | 420/40 |
| 2004/0042926 | A1 * | 3/2004 | Shimizu | 420/38 |
| 2010/0047108 | A1 * | 2/2010 | Gay et al. | 420/109 |
| 2011/0206503 | A1 | 8/2011 | Ferrer et al. | |
| 2011/0211945 | A1 | 9/2011 | Ferrer et al. | |
| 2011/0268566 | A1 | 11/2011 | Ferrer et al. | |
| 2012/0132326 | A1 | 5/2012 | Ferrer et al. | |

FOREIGN PATENT DOCUMENTS

| | | | |
|---|---|---|---|
| EP | 0 577 997 | | 1/1994 |
| JP | 51147405 | A * | 12/1976 |
| JP | 06336657 | A * | 12/1994 |

OTHER PUBLICATIONS

Derwent Acc No. 2008-D08275 for Patent family including FR 2,904,634 A published Feb. 8, 2008 by Gay et al.*
U.S. Appl. No. 13/382,052, filed Mar. 23, 2012, Ferrer.
U.S. Appl. No. 13/501,610, filed Apr. 12, 2012, Ferrer, et al.
U.S. Appl. No. 13/501,377, filed Apr. 11, 2012, Ferrer, et al.
International Search Report Issued Dec. 27, 2010 in PCT/FR10/52141 Filed Oct. 11, 2010.

* cited by examiner

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

The invention relates to a method of fabricating a stainless martensitic steel, comprising a step of electroslag remelting of an ingot of said steel then a step of cooling said ingot. Before the electroslag remelting step, the ingot undergoes vacuum degassing for a time that is sufficient to obtain a hydrogen content in the ingot of less than 3 ppm.

12 Claims, 2 Drawing Sheets

DEGASSING OF MARTENSITIC STAINLESS STEEL BEFORE REMELTING BENEATH A LAYER OF SLAG

BACKGROUND OF THE INVENTION

1. Field of the Invention

The present invention relates to a method of fabricating a stainless martensitic steel, comprising a step of electroslag remelting of an ingot of said steel then a step of cooling said ingot.

In the present invention, unless otherwise stated, the composition percentages are percentages by weight.

2. Description of the Related Art

A stainless martensitic steel is a steel with a chromium content of more than 10.5% and of a structure that is essentially martensitic.

It is important for the fatigue behavior of such a steel to be as good as possible so that the service life of parts produced from such a steel is maximized.

To this end, it is sought to improve the inclusion characteristics of the steel, i.e. to reduce the quantity of undesirable inclusions (certain alloy, oxide, carbide, and intermetallic compound phases) present in the steel. Such inclusions act as crack initiation sites that, under cyclic loading, result in premature failure of the steel.

Experimentally, a large dispersion is observed in the results of fatigue tests carried out on test specimens of that steel, i.e. for each level of fatigue loading under imposed deformation, the service life (corresponding to the number of cycles resulting in breaking of a fatigue specimen in that steel) varies over a wide range. Inclusions are responsible for the minimum values, in the statistical sense, for the fatigue service life of the steel (low values of the range).

In order to reduce that dispersion in fatigue behavior, i.e. in order to raise those low values, and also to enhance the mean fatigue behavior value, it is necessary to improve the inclusion characteristics of the steel. The electroslag remelting technique, ESR, is known. In that technique, the steel ingot is placed in a crucible into which a slag (mixture of minerals, for example lime, fluorides, magnesia, alumina, calcite) is poured such that the lower end of the ingot is immersed in the slag. Next, an electric current is passed through the ingot, which acts as an electrode. That current is sufficiently high to heat and liquefy the slag and to heat the lower end of the steel electrode. The lower end of that electrode is in contact with the slag, and so it melts and passes through the slag in the form of fine droplets, and then solidifies below the layer of slag, which floats, to form a new ingot that therefore grows gradually. The slag acts, inter alia, as a filter that extracts the inclusions from the steel droplets, such that the steel of that new ingot located below the layer of slag contains fewer inclusions than the initial ingot (electrode). That operation is carried out at atmospheric pressure and in air.

Although the ESR technique can reduce the dispersion in the fatigue behavior of stainless martensitic steels by eliminating inclusions, that dispersion is still too large in terms of the service life of the parts.

Non-destructive testing using ultrasound carried out by the inventors has shown that said steels include practically no known hydrogen defects (flakes).

The dispersion of the fatigue behavior results, specifically the low end values of the range of results, is thus due to another undesirable mechanism of premature initiation of cracks in the steel, which results in premature fatigue breaking.

BRIEF SUMMARY OF THE INVENTION

The aim of the present invention is to provide a fabrication method that can raise these low values and thus reduce the dispersion of the fatigue behavior of stainless martensitic steels and enhance its mean fatigue behavior.

This aim is achieved in that before the electroslag remelting step, the ingot undergoes vacuum degassing for a time sufficient to obtain a hydrogen content in the ingot of less than 3 ppm [parts per million].

These means reduce the formation of gas phases of microscopic dimensions (not detectable by industrial non-destructive testing means) constituted by light elements within the steel, and thus avoid premature initiation of cracks from said microscopic phases, which give rise to premature failure of the steel under fatigue.

BRIEF DESCRIPTION OF THE SEVERAL VIEWS OF THE DRAWINGS

The invention and its advantages can be better understood from the following detailed description of an implementation shown by way of non-limiting example. The description makes reference to the accompanying drawings in which.

DETAILED DESCRIPTION OF THE INVENTION

Figure 3:
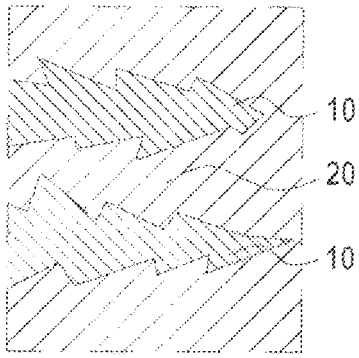
FIG. 3 is a diagram illustrating dendrites and interdendritic regions.

During the ESR process, the steel that has been filtered by the slag cools and gradually solidifies to form an ingot. This solidification occurs during cooling and involves the growth of dendrites, as illustrated in FIG. 3. In agreement with the phase diagram for stainless martensitic steels, the dendrites 10, corresponding to the first solidified grains, are by definition richer in alphagenic elements, while the interdendritic regions 20 are richer in gammagenic elements (application of the known lever rule for phase diagrams). An alphagenic element is an element that favors a ferritic type structure (structures that are more stable at low temperatures: bainite, ferrite-pearlite, martensite). A gammagenic element is an element that favors an austenitic structure (a structure that is stable at high temperatures). Thus, segregation occurs between the dendrites 10 and the interdendritic regions 20.

This local segregation in the chemical composition is then retained throughout fabrication, even during subsequent hot forming operations. Thus, this segregation is found both in the as-solidified ingot and in the subsequently deformed ingot.

Once the material has solidified, the dendrites 10 are initially transformed into ferritic structures during cooling, while the interdendritic regions 20 are subsequently transformed, in part or in full, at lower temperatures, and thus retain an austenitic structure for longer.

During said solid state cooling, a local structural heterogeneity exists with cohabitation of austenitic and ferritic type microstructures. Under these conditions, light elements (H, N, O), which are more soluble in the austenite than in the ferritic structures, have a tendency to become concentrated in the interdendritic regions 20. This concentration is increased by the larger quantity of gammagenic elements in the interdendritic regions. At temperatures of less than 300° C., the light elements only diffuse at extremely low rates and remain trapped in their region. After complete or partial transformation of the interdendritic zones into a ferritic structure, the solubility limit of these gas phases is reached under certain concentration conditions and these gas phases form pockets of gas (or a substance in a physical state that provides high malleability and incompressibility).

During the cooling phase, the larger the diameter of the ingot (or the subsequently deformed ingot) at the end of the ESR (or, more generally, the larger the maximum dimension of the ingot), or the lower the cooling rate of the ingot, the greater is the tendency for the light elements to diffuse from the dendrites towards the interdendritic regions where they become concentrated during the period for cohabitation of ferritic and austenitic structures. The risk of the solubility of these light elements being locally exceeded in the interdendritic regions is accentuated. When the concentration of light elements exceeds this solubility, microscopic gas pockets containing said light elements then appear in the steel.

In addition, while cooling is finishing, the austenite of the interdendritic regions tends to be transformed locally into martensite when the temperature of the steel falls below the martensitic transformation temperature Ms, which is above ambient temperature. However, martensite has a solubility threshold for light elements that is lower than austenite. Thus, more microscopic gas phases appear in the steel during this martensitic transformation.

During subsequent deformations that the steel undergoes during hot forming (for example forging), these phases flatten out into a sheet form.

Under fatigue loading, these sheets act as stress concentration sites that are responsible for premature initiation of cracks by reducing the energy necessary for crack initiation. This then results in premature failure of the steel, which gives rise to the low values in the fatigue behavior results.

Figure 4:
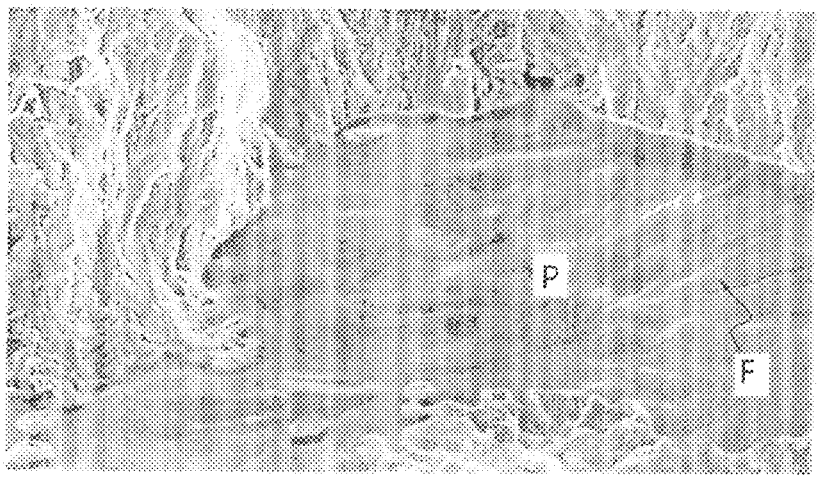
FIG. 4 is a photograph taken using an electron microscope of a fracture surface after fatigue, showing the gas phase that initiated that fracture.

These conclusions have been corroborated by the inventors' observations, as the electron microscope photograph of FIG. 4 shows.

On this photograph of a fracture surface of a stainless martensitic steel, a substantially globular zone P can be seen from which cracks F radiate. This zone P is the footprint of the gas phase constituted by light elements that is at the origin of the formation of these cracks F that, by propagating and agglomerating, have created a macroscopic fracture zone.

The inventors have carried out tests on stainless martensitic steels and found that when, prior to electroslag remelting, such a steel in the liquid state undergoes a vacuum degassing operation for a time that is sufficient to obtain a H (hydrogen) content in said ingot of less than 3 ppm by weight, then firstly this H (hydrogen) content is insufficient to result in recombination between H and O (oxygen) and N (nitrogen) in the gas phases that are likely to be formed after electroslag remelting of that steel.

Secondly, this reduced quantity of gaseous elements remains below that which would result in exceeding the solubility of these gas phases even in martensite after concentration in the austenitic structures cohabiting with the ferritic structures. This enables the concentration of gammagenic elements in the interdendritic regions and the concentration of alphagenic elements in the dendrites to be kept substantially constant. The risk of undesirable gas phases forming within the steel is thus reduced.

Preferably, the slag is dehydrated before being used in the ESR crucible. In fact, it is possible for the concentration of H in the steel ingot from electroslag remelting, ESR, to be higher than the concentration of H in said ingot before its electroslag remelting. Hydrogen can then pass from the slag into the ingot during the ESR method. By dehydrating the slag in advance, the quantity of hydrogen present in the slag is minimized and thus the quantity of hydrogen that could pass from the slag into the ingot during the ESR method is minimized.

Preferably, before ESR the liquid metal ingot undergoes vacuum degassing for a time that is sufficient to obtain a hydrogen content in the ingot after the electroslag remelting step that is less than 3 ppm.

The method for vacuum degassing an alloy is known, and so the description below is brief. It consists in placing the still-liquid ingot in a vessel in which at least a low vacuum is produced. Alternatively, said vacuum degassing may be carried out by immersing in the liquid steel, contained in a container, a line linked to a ladle in which the vacuum is produced. The steel is sucked into this ladle by the vacuum prevailing therein, then falls back into the container via the line. The ladle may also include an inlet line and an outlet line both of which are immersed in the liquid steel, with the steel then passing via the ladle, entering via the inlet line and leaving via the outlet line.

Upstream of the vacuum degassing method, the steel generally undergoes refining at ambient atmosphere. Said refining can produce a fine chemical concentration and reduce the sulfur and carbon content by as much as possible within the desired range. With martensitic stainless steels, the most economical industrial facility used is argon oxygen decarburization (AOD), which is carried out at ambient atmosphere. The combination constituted by this AOD method followed by vacuum degassing as described above constitutes a method that has the advantage of being less expensive and faster to carry out than methods of extracting impurities that are carried out in a vacuum vessel, such as VOD (vacuum-oxygen-decarburization).

The inventors have carried out tests on Z12CNDV12 steels prepared using the method of the invention, i.e. with degassing of the ingot, employing the above parameters prior to the ESR; the results of these tests are presented below.

The composition of the Z12CNDV12 steels was as follows (DMD0242-20 standard, index E):

C (0.10% to 0.17%)-Si (<0.30%)-Mn (0.5% to 0.9%)-Cr (11% to 12.5%)-Ni (2% to 3%)-Mo (1.50% to 2.00%)-V (0.25% to 0.40%)-$N_2$ (0.010% to 0.050%)-Cu (<0.5%)-S (<0.015%)-P (<0.025%) and satisfying the criterion:

$$4.5 \leq (Cr-40.C-2.Mn-4.Ni+6.Si+4.Mo+11.V-30.N) < 9$$

Figure 1:
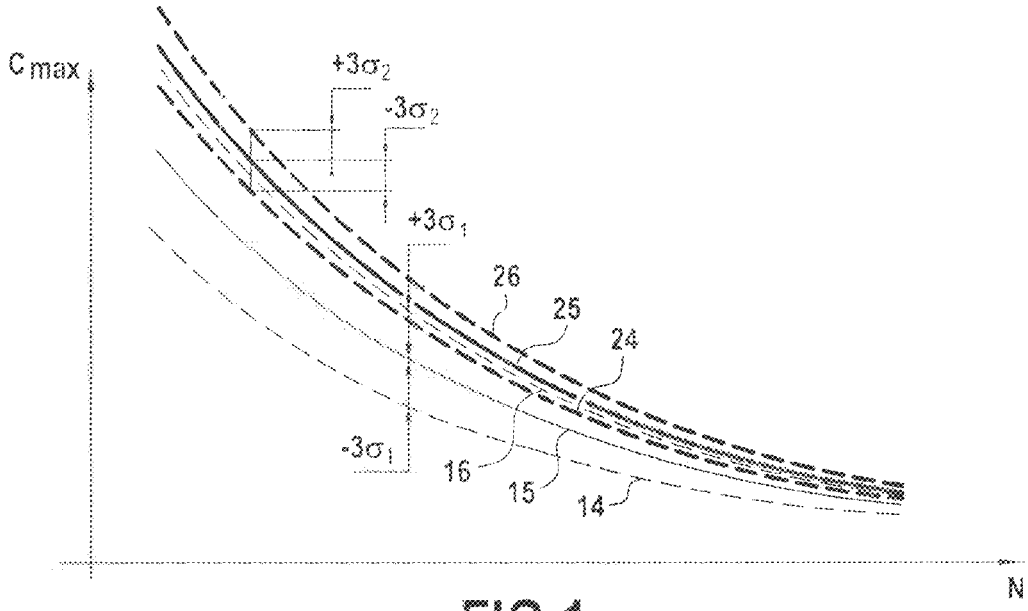
FIG. 1 compares the fatigue service life curves for a steel of the invention and a prior art steel.

FIG. 1 qualitatively shows the improvements brought about by the method of the invention.

Experimentally, a value was obtained for the number N of cycles to breaking needed to break a steel specimen subjected to cyclic tensile loading as a function of the pseudo alternating stress C (the load on the specimen under imposed deformation, in accordance with Snecma standard DMC0401 used for these tests).

Figure 2:
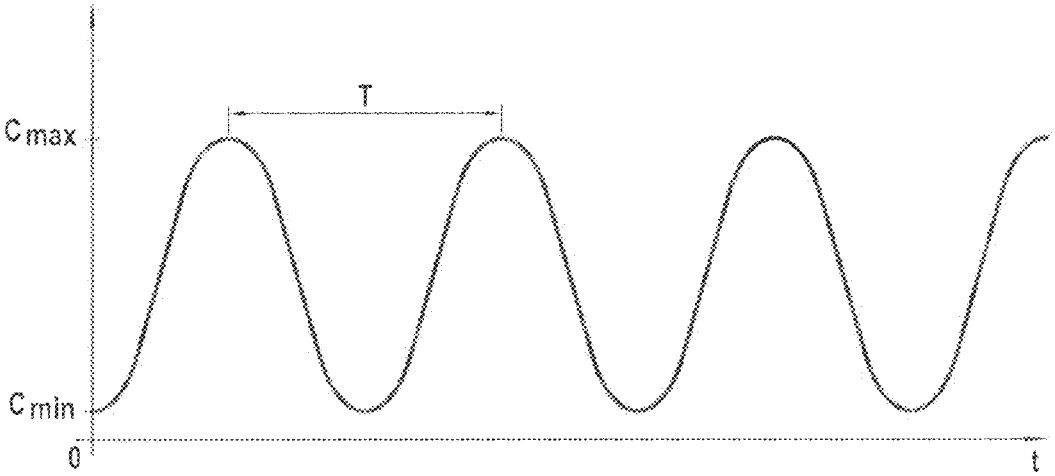
FIG. 2 shows a fatigue loading curve.

Such a cyclic loading is shown diagrammatically in FIG. 2. The period T represents one cycle. The stress changes between a maximum value $C_{max}$ and a minimum value $C_{min}$.

By fatigue testing a statistically sufficient number of specimens, the inventors obtained points N=f(C) from which they drew up a mean statistical C-N curve (stress C as a function of the number N of fatigue cycles). The standard deviations for the loads were than calculated for a given number of cycles.

In FIG. 1, the first curve 15 (narrow line) is (diagrammatically) the mean curve obtained for a steel produced in accordance with the prior art. This first mean C-N curve is between two curves 16 and 14 shown as narrow dashed lines. These curves 16 and 14 are located respectively at a distance of $+3\sigma_1$ and $-3\sigma_1$ from the first curve 15, $\sigma_1$ being the standard deviation of the distribution of the experimental points obtained during these fatigue tests; $\pm 3\sigma_1$ corresponds in statistics to a confidence interval of 99.7%. The distance between these two dashed line curves 14 and 16 is thus a measure of the dispersion of the results. The curve 14 is the limiting factor for the dimensions of a part.

In FIG. 1, the second curve 25 (thick line) is (diagrammatically) the mean curve obtained from the fatigue test results carried out on a steel produced in accordance with the invention under loading in accordance with FIG. 2. This second mean C-N curve lies between two curves 26 and 24 shown as thick dashed lines, located respectively at a distance of +3(2 and −3(2 from the second curve 25, (2 being the standard deviation of the experimental points obtained during these fatigue tests. The curve 24 is the limiting factor for the dimensions of a part.

It should be noted that the second curve 25 is located above the first curve 15, which means that under a fatigue loading at a loading level C, steel specimens produced in accordance with the invention break on average at a higher number N of cycles than that at which the prior art steel specimens break.

In addition, the distance between the two curves 26 and 24 shown as thick dashed lines is smaller than the distance between the two curves 16 and 14 shown as thin dashed lines, which means that the fatigue behavior dispersion of the steel produced in accordance with the invention is smaller than that of a prior art steel.

FIG. 1 illustrates the experimental results summarized in Table 1 below.

Table 1 gives the results for oligocyclic fatigue loading in accordance with FIG. 2 with a zero minimum stress Cmin, at a temperature of 250° C., with N=20000 cycles, and N=50000 cycles. "Oligocyclic fatigue" means that the loading frequency is of the order of 1 Hz (the frequency being defined as the number of periods T per second).

TABLE 1

| Oligocyclic fatigue test conditions | | Prior art steel | | Steel produced in accordance with invention | |
|---|---|---|---|---|---|
| N | Temperature | $C_{min}$ | Dispersion | $C_{min}$ | Dispersion |
| $2 \times 10^5$ | 200° C. | 100% = M | 120% M | 130% M | 44% M |
| $5 \times 10^4$ | 400° C. | 100% = M | 143% M | 130% M | 90% M |

It should be noted that for a given value of the number of cycles N, the minimum fatigue loading value necessary to break a steel of the invention is higher than the minimum value M for the fatigue loading (fixed at 100%) necessary to break a prior art steel. The dispersion (=6( )for the results at this number N of cycles for a steel of the invention is smaller than the dispersion for the results for a prior art steel (dispersions expressed as a percentage of the minimum value M).

Advantageously, the carbon content of the stainless martensitic steel is lower than the carbon content below which the steel is hypoeutectoid, for example a content of 0.49%. In fact, a low carbon content allows better diffusion of the alloying elements and a reduction in the solution temperatures for primary or noble carbides, which results in better homogenization.

Before electroslag remelting, a martensitic steel, for example, will have been produced in air.

The invention claimed is:

1. A method of fabricating a stainless martensitic steel, the method comprising:

vacuum degassing an ingot comprising a steel in a liquid metal state for a time sufficient to obtain a hydrogen content in the ingot of less than 3 ppm; then electroslag remelting the ingot; and then cooling the ingot.

2. The method ofclaim 1, further comprising, prior to the remelting:

dehydrating the slag.

3. The method of claim 2, wherein the vacuum degassing is carried out for a time that is sufficient to obtain a hydrogen content in the ingot after the electroslag remelting of less than 3 ppm.

4. The method of claim 2, further comprising, prior to the degassing:

refining the ingot in an ambient atmosphere.

5. The method of claim 2, wherein a carbon content of the steel is less than 0.49 wt %, based on a total weight of the steel.

6. The method of claim 1, wherein the vacuum degassing is carried out for a time that is sufficient to obtain a hydrogen content in the ingot after the electroslag remelting of less than 3 ppm.

7. The method of claim 6, further comprising, prior to the degassing:

refining the ingot in an ambient atmosphere.

8. The method of claim 6, wherein a carbon content of the steel is less than 0.49 wt %, based on a total weight of the steel.

9. The method of claim 1, further comprising, prior to the degassing;

refining the ingot in an ambient atmosphere.

10. The method of claim 9, wherein a carbon content of the steel is less than 0.49 wt %, based on a total weight of the steel.

11. The method of claim 1, wherein a carbon content of the steel is less than the carbon content below which the steel is hypoeutectoid.

12. The method of claim 11, wherein a carbon content of the steel is less than 0.49 wt %, based on a total weight of the steel.

* * * * *